US007518584B2

(12) United States Patent
Heynderickx et al.

(10) Patent No.: US 7,518,584 B2
(45) Date of Patent: Apr. 14, 2009

(54) METHOD OF DISPLAYING AN IMAGE ON A COLOR DISPLAY

(75) Inventors: Ingrid Emilienne Joanna Rita Heynderickx, Eindhoven (NL); Erno Hermanus Antonius Langendijk, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 260 days.

(21) Appl. No.: 10/543,282

(22) PCT Filed: Jan. 16, 2004

(86) PCT No.: PCT/IB2004/050028

§ 371 (c)(1),
(2), (4) Date: Jul. 25, 2005

(87) PCT Pub. No.: WO2004/068459

PCT Pub. Date: Aug. 12, 2004

(65) Prior Publication Data

US 2006/0158454 A1 Jul. 20, 2006

(30) Foreign Application Priority Data

Jan. 28, 2003 (EP) ..... 03100163

(51) Int. Cl.
*G09G 3/36* (2006.01)

(52) U.S. Cl. ..... 345/88; 345/690

(58) Field of Classification Search ..... 345/589, 345/204, 694, 84, 600, 603, 604, 3.3, 22, 345/72, 83, 88, 89, 690, 591, 593, 597
See application file for complete search history.

(56) References Cited

U.S. PATENT DOCUMENTS

| | | | | |
|---|---|---|---|---|
| 4,843,381 | A | 6/1989 | Baron | |
| 6,037,921 | A | 3/2000 | Matsumoto et al. | |
| 6,262,744 | B1 | 7/2001 | Carrein | |
| 7,113,152 | B2 * | 9/2006 | Ben-David et al. | 345/32 |
| 2004/0051724 | A1 * | 3/2004 | Elliott et al. | 345/694 |

FOREIGN PATENT DOCUMENTS

| | | | |
|---|---|---|---|
| GB | 2282928 | A | 4/1995 |
| WO | 9724871 | A1 | 7/1997 |
| WO | 02101644 | A2 | 12/2002 |
| WO | WO 02/101644 | A2 * | 12/2002 |

OTHER PUBLICATIONS

International Application Published Under the Patent Cooperation Treaty; PCT Publication No. WO 02/101644 A2; Publication Date: Dec. 12, 2002; Inventors Ilan Ben-David, Shmuel Roth and Mosh Ben-Chorin; referred to as "PCT '644".*

* cited by examiner

*Primary Examiner*—Regina Liang

(57) ABSTRACT

A method of displaying an image on a color display comprises receiving image data to be displayed, forming a first sub image and a second sub image from said image data, said first sub image comprising a first set of colors and said second sub image comprising a second set of colors, wherein said first set of colors and said second set of colors are disjoint sets, and wherein said first set of colors and said second set of colors comprise a metamer formed by at least a first color in said first set of colors and at least a second color in said second set of colors, and displaying said image using said first sub image and said second sub image, or a representation thereof, on a color display.

23 Claims, 7 Drawing Sheets

| | | | | | | | | | | | | | | | |
|---|---|---|---|---|---|---|---|---|---|---|---|---|---|---|---|
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |

| | | | | | | | | | | | | | | | |
|---|---|---|---|---|---|---|---|---|---|---|---|---|---|---|---|
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |
| R | G | B | Y | R | G | B | Y | R | G | B | Y | R | G | B | Y |

METHOD OF DISPLAYING AN IMAGE ON A COLOR DISPLAY

The present invention relates to a method of displaying an image on a color display. The present invention also relates to a display controller arranged to perform the method of displaying an image on a color display. The present invention furthermore relates to a color display comprising such a display controller.

Vision is the sense, mediated by the eyes, by which the qualities of an object (such as color, luminosity, shape and size) constituting its appearance are perceived.

Color is defined as an attribute of visual perception consisting of any combination of chromatic and achromatic content. This attribute can be described by chromatic color names such as yellow, orange, brown, red, pink, green, blue, purple, etc., or by achromatic color names such as white, grey, black, etc., and qualified by bright, dim, light, dark, etc., or by combinations of such names.

A perceived color depends on the spectral distribution of the color stimulus, on the size, shape, structure and surround of the stimulus area, on the state of adaptation of the observer's visual system, and on the observer's experience of the prevailing and similar situations of observations.

The unrelated attributes of color are brightness, hue and saturation. Brightness is the attribute of a visual sensation according to which an area appears to emit more or less light. Hue is an attribute of a visual sensation according to which an area appears to be similar to one of the perceived colors, e.g. red, yellow, green, and blue, or to a combination of them. Saturation is the colorfulness, chromaticity, of an area judged in proportion to its brightness.

The related attributes of color are lightness, colorfulness and chrome Lightness is defined as the brightness of an area judged relative to the brightness of a similarly illuminated area that appears to be white or highly transmitting. Colorfulness is an attribute of a visual sensation according to which the perceived color of an area appears to be more or less chromatic. Chroma is defined as the colorfulness, chromaticity, of an area judged as a proportion of the brightness of a similarly illuminated area that appears white or highly transmitting.

In the retina of the eye there are three different types of light sensors. These sensors are called the L, M and S cones, which are sensitive to light with long (L), medium (M) and short (S) wavelengths, respectively. Each type of sensor is connected with neurones to the brain. When light falls onto a cone it will start to send pulses to the brain when it is sensitive to the wavelength of the light. FIG. 1 shows the spectral sensitivities of L, M and S cones in the human eye. The more light that falls onto the cones the quicker it will send pulses ("fire spikes") to the brain.

The color of the light that enters the eye is determined by the relative amount of pulses that each of the three types of cones sends to the brain. Blue light (wavelength approximately 400-450 nm), for example, results in more spikes from the S cones than from the L cones or the M cones.

Because the human eye has only three types of cones, there are a number of different light spectra that give the same color sensation. For example, sunlight and the light from a fluorescent lamp are both perceived a white color, but whereas the sunlight has a very broad spectrum with about equal intensity for each wavelength, the fluorescent lamp has a spectrum with only a few peaks. This effect of different light spectra giving the same color sensation is called metamerism and two spectra which give the same color sensation are called metamers.

Another effect of having only three types of cones is that different colors can be made by adding the light of two light sources while varying the relative intensity of the light sources as compared to each other. If red light and green light are mixed, they may be perceived as yellow. If a first light source emitting red light is set to full intensity and a second light source emitting green light is set to zero intensity, and the intensity of the green light is increased while the intensity of the red light is decreased, color changes from red, to orange, to yellow, to green can be observed.

Displays use this principle to make many colors with only three primary colors; usually red, green and blue.

In order to predict the color sensation that we get from the light that enters our eyes, a number of models have been developed. One of these models, which is most commonly known and which is standardised by the CE (Commission Internationale d'Éclairage—International Commission on Illumination) is the CIE 1931 model. It defines three spectral matching functions for the standard observer that can be used to calculate the tri-stimulus values X, Y, and Z, respectively, for a light with a certain spectrum. From these tri-stimulus values the chromaticity coordinates x and y can be calculated as follows:

$$x = \frac{X}{X+Y+Z} \tag{1}$$

$$y = \frac{Y}{X+Y+Z} \tag{2}$$

The Y is related to the perceptual attribute brightness, the x and y coordinates determine the chromaticity, where x is the red-green axis and y is the yellow-blue axis.

The relation between colors (while ignoring the intensity, Y) can now be plotted in a two-dimensional chromaticity diagram, such as FIG. 2. It shows the chromaticity coordinates of the spectral colors by the curved line and indicates the corresponding wavelengths in nanometers (nm). Chromaticity coordinates for all visible colors are on the horseshoe-shaped area inside the curved line. The straight line at the bottom of the chart (the purple line) connects the red and the blue spectral colors, so that non-spectral colors mixed of red and blue (e.g. purple, violet, etc.) are located along this line. The chromaticity coordinate of a white object in daylight is designated D in FIG. 2. The direction and the distance of a certain point in the chromaticity diagram to the white point determine its hue and saturation.

As mentioned previously, mixing the light of two colors can create a new color. The chromaticity coordinate of this new color is on an imaginary straight line between the two colors. Mixing green (G) and cyan (C) will for instance give a color whose chromaticity coordinate is on the line between G and C as given in FIG. 2. By adding a third color, e.g. red (R), all colors within an imaginary triangle, spanned by R, G, and C, can be made. By mixing light of six different primary colors (e.g. R, Y, G, C, B, M), all colors with chromaticity coordinates in the patch R, Y, G, C, B, M, i.e. inside a polygon, the corners of which are R, Y, G, C, B, and M, can be made.

The chromaticity diagram only shows the proportions of tristimulus values; hence bright and dim colors having the same tristimulus proportions belong to the same point. For this reason, the illuminant point D also represents grey colors;

and orange and brown colors, for example, tend to plot at similar positions to each other.

The subject matter of color vision is further elucidated in e.g. Roy S. Berns, Fred W. Billmeyer, and Max Saltzman; Billmeyer and Saltzman's Principles of Color Technology, 3rd Edition; ISBN 0-471-19459-X, hereby incorporated in its entirety by this reference.

The present invention relates to the field of displays in general, and in particular to liquid crystal displays (LCD), cathode ray tube (CRT) displays, flat intelligent tube (FIT) displays, light emitting diode (LED) displays, all of which will be explained briefly in the following, as well as to plasma display panels (PDP), PolyLED displays, organic light emitting displays (OLED), field emission displays (FED), and foil displays.

In prior art, liquid crystal displays have proven themselves suitable for various applications which necessitate compactness and low power consumption. A liquid crystal display (LCD) is a flat panel display device having the advantages of small bulk, small thickness and low power consumption.

LCDs have been used in connection with portable devices such as mobile telephones, portable computers, electronic calendars, electronic books, televisions or video game controls and various other office automation equipment and audio/video machinery, etc.

LCDs control an electric field which is applied to a liquid crystal material having a dielectric anisotropy to transmit or shut off light, thereby displaying a picture or an image, all in a fashion known per se as is recognized by those skilled in the art. Unlike display devices that generate light internally—such as electro luminescence (EL) devices, cathode ray tubes (CRT) and light emitting diodes (LED)—LCDs use an external light source.

Normally, an LCD display is designed as a liquid crystal panel, comprising a matrix of essentially rectangular display elements (pixels) which are controllable to transmit or reflect light depending on the properties of the liquid crystal mixture, which is generally injected between two transparent substrates, the display in addition comprising row and column conductors for supplying voltages to selected parts of the display, via associated electronics such as row and column drivers, as will be recognized by the skilled man.

LCD devices are largely classified into transmissive type devices and reflective type devices, depending on the method of utilizing light. Transmissive-type LCDs include a back light unit for supplying light to the liquid crystal panel.

Light emitting diodes (LED) have been used to create big-screen devices such as jumbo-TVs. Depending on the desired pixel size, a number of red, green and blue light emitting diodes may be grouped together to form a single display element, corresponding to a pixel in an LCD display. Such display elements are subsequently arranged in a rectangular matrix and connected to necessary electronics as will be recognized by the skilled man.

FIG. 3 is a schematic illustration of the fundamental principle of the cathode ray tube (CRT), which is comprised in many TVs in use today as well as many other display devices. A cathode 31, for instance a heated filament, is arranged inside a glass tube 32, in which a vacuum has been created. Electrons are naturally released from the heated cathode 31 and into the tube 32. An anode 33 attracts the electrons, which are released from the cathode 31, thus forming a beam or ray of electrons 34. In the cathode ray tube 32 of a television set, the beam of electrons 34 is focused by a focusing anode 33 into a tight beam and then accelerated by an accelerating anode 35. The beam of electrons 34 flies through the vacuum inside the tube 32 and hits a flat screen 36 at the other end of the tube 32. This screen 36 is coated with phosphor 37, which glows when struck by the electron beam 34. Conductive coating inside the tube soaks up the electrons which pile up at the screen-end of the tube.

In order to provide means to guide the beam 34, the tube 32 in a typical CRT display device is wrapped in steering coils 38, 39. The steering coils 38, 39 are simply copper windings, which are able to create magnetic fields inside the tube, and the electron beam 34 responds to the fields. A first set of coils 38 creates a magnetic field that moves the electron beam vertically, while a second set of coils 39 moves the beam horizontally. By controlling the voltages applied to the coils 38, 39, the electron beam 34 can be positioned at any point on the screen 36.

A color CRT display comprises three electron beams, typically denoted the red, green and blue beams, which move simultaneously across the screen. Instead of the single sheet of phosphor which is arranged at the screen in black-and-white CRT display devices, the screen in a color CRT display is coated with red, green and blue phosphors arranged in dots or stripes. On the inside of the tube, very close to the phosphor coating, there is arranged a thin metal screen, the shadow mask. This mask is perforated with very small holes that are aligned with the phosphor dots (or stripes) on the screen.

A red dot may be created by firing the red beam at the red phosphor, whereas green and blue dots are created in a corresponding fashion. To create a white dot, red, green and blue beams are fired simultaneously—the three colors mix together to create white. To create a black dot, all three beams are turned off as they scan past the dot. All other colors on a color CRT display are combinations of red, green and blue. CRT displays are typically time sequential displays, which implies that an image is built up by repeatedly scanning the beam(s) over the screen, whereupon an image is displayed, all in a manner known per se as will be appreciated by the skilled man.

The Flat Intelligent Tube (sometimes referred to as FIT or FIT) is a new cathode ray tube (CRT) technology without a shadow mask. The primary function of the shadow mask, color selection, is managed by an electronic control system that guides the electron beams over the correct phosphor lines. The position of the beams is detected by means of dedicated structures on the faceplate.

FIG. 4 is a simplified representation of the tracking principle in a FIT display 40. In the FIT display 40, the beams 34 are scanned along horizontal phosphor lines 41, in contrast to maskless CRTs of the index type developed in the past in which a single beam was scanned perpendicularly to the vertical phosphor lines. The FIT approach is quite similar to that of a CD-player wherein a laser beam is guided over a spiral by means of a tracking system. The beam 34 is scanned along a horizontal phosphor line 41 and any deviation from this line is corrected by means of a feedback system. On tracks situated above and below each phosphor line 41, position detectors 42 are present (e.g. conducting stripes that measure the current). A display controller 43, fed by information from these detectors 42, drives correction coil(s) 44 in such a way that the beam trajectories coincide with the phosphor lines 41.

In the CRT and FIT displays, the phosphor dots or stripes constitute the display elements, which accordingly are controllable to emit light having a predetermined wavelength (color).

In prior art RGB color displays, the displayable color gamut is limited to a color triangle, which is spanned by three primary colors, e.g. red, green and blue (as illustrated in FIG. 2). Colors outside this color triangle, e.g. gold and turquoise (in a case where the primary colors are red, green and blue), cannot be displayed and are consequently clipped towards colors that can be displayed, e.g. more unsaturated yellow and more bluish green. It is known that adding one or more additional primary colors to the three primary colors used in most present applications offers a possibility to expand the displayable color gamut.

Spatial resolution is the ability of a display system to display two objects close together as separate dots. For all display types that cannot project various color pixels on top of each other, the addition of a sub pixel with another color primary yields a reduction in the spatial resolution of the display if the number of sub pixels remains equal.

The smallest switching element is the sub pixel. If the sub pixels are made smaller, there can be four sub pixels in one pixel having the same size as a pixel with three sub pixels. This is, however, costly and generally speaking resolution decreases as the amount of sub pixels increases. If, on the other hand, the size of sub pixels is kept constant and four, instead of three, sub pixels are used to form a pixel, the pixel resolution will decrease.

Furthermore, the addition of more than three colors may result in errors relating to color, luminance and image homogeneity.

It is accordingly a disadvantage that the addition of a primary color results in a reduction in the spatial resolution of the display and hence a reduction in the overall image quality.

It is an object of the invention to provide a method of displaying an image on a color display, whereby the reduction in the spatial resolution of a display, which results from the addition of more primary colors is limited.

It is a further object of the invention to provide a method of displaying an image on a color display whereby increased color gamut is obtained without the corresponding loss in resolution in the luminance signal which prior art is associated with.

These and other aspects of the invention will be apparent from and elucidated with reference to the embodiments described hereinafter.

Essentially speaking, the invention relates to a new and innovative method of displaying an image on a color display comprising a plurality of spatially distributed display elements (such as pixels), said display elements having four or more primary colors. According to the invention, increased color gamut is obtained without the corresponding loss in resolution in the luminance signal which prior art is associated with.

Figure 7A:
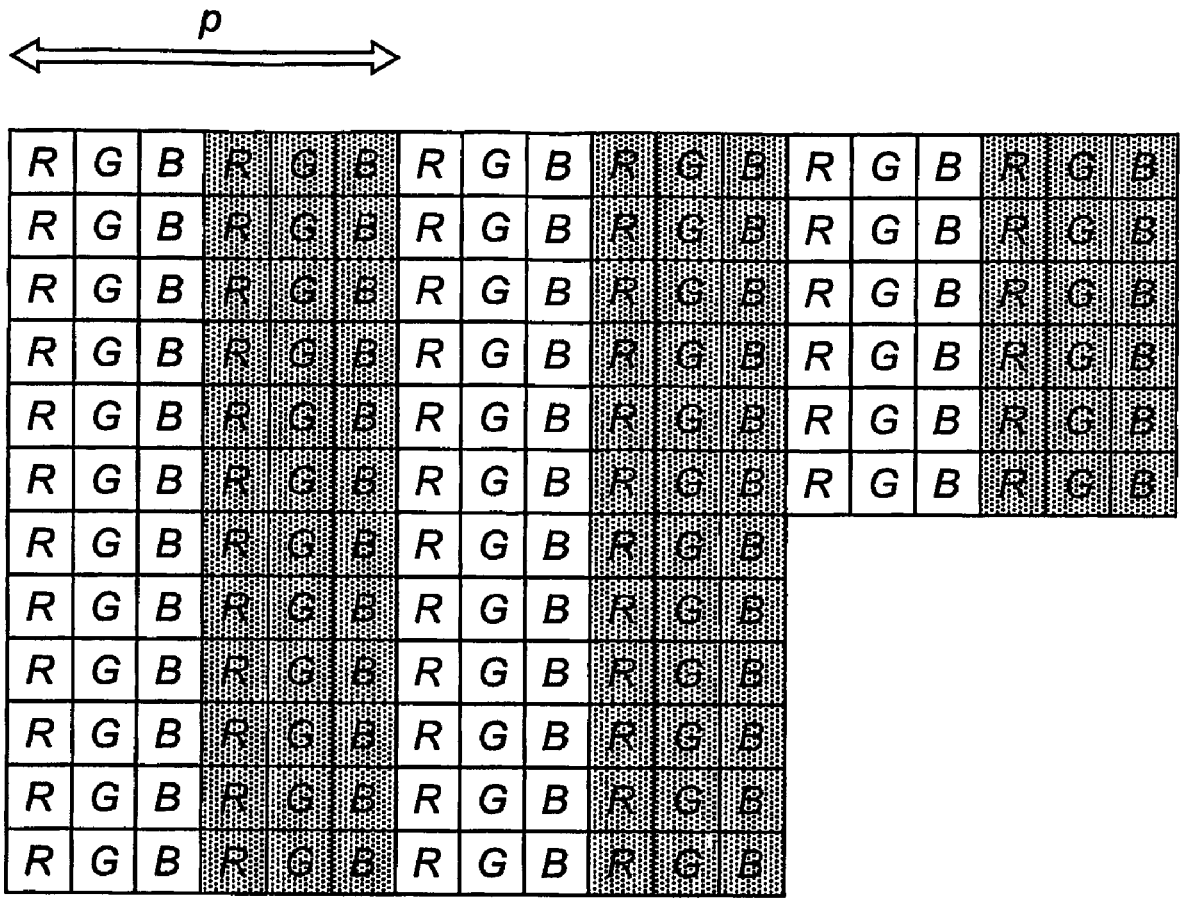
Figure 7B:
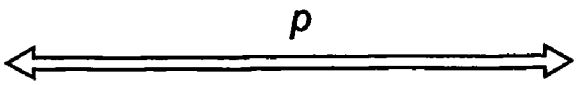
Figure 7C:
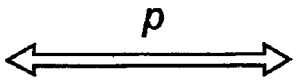

FIGS. 7*a*, 7*b* and 7*c* are schematic illustrations of the perceived images on the screens of a prior art three color display, a four color display according to prior art technology and a four color display according to an aspect of the invention.

Figure 8:
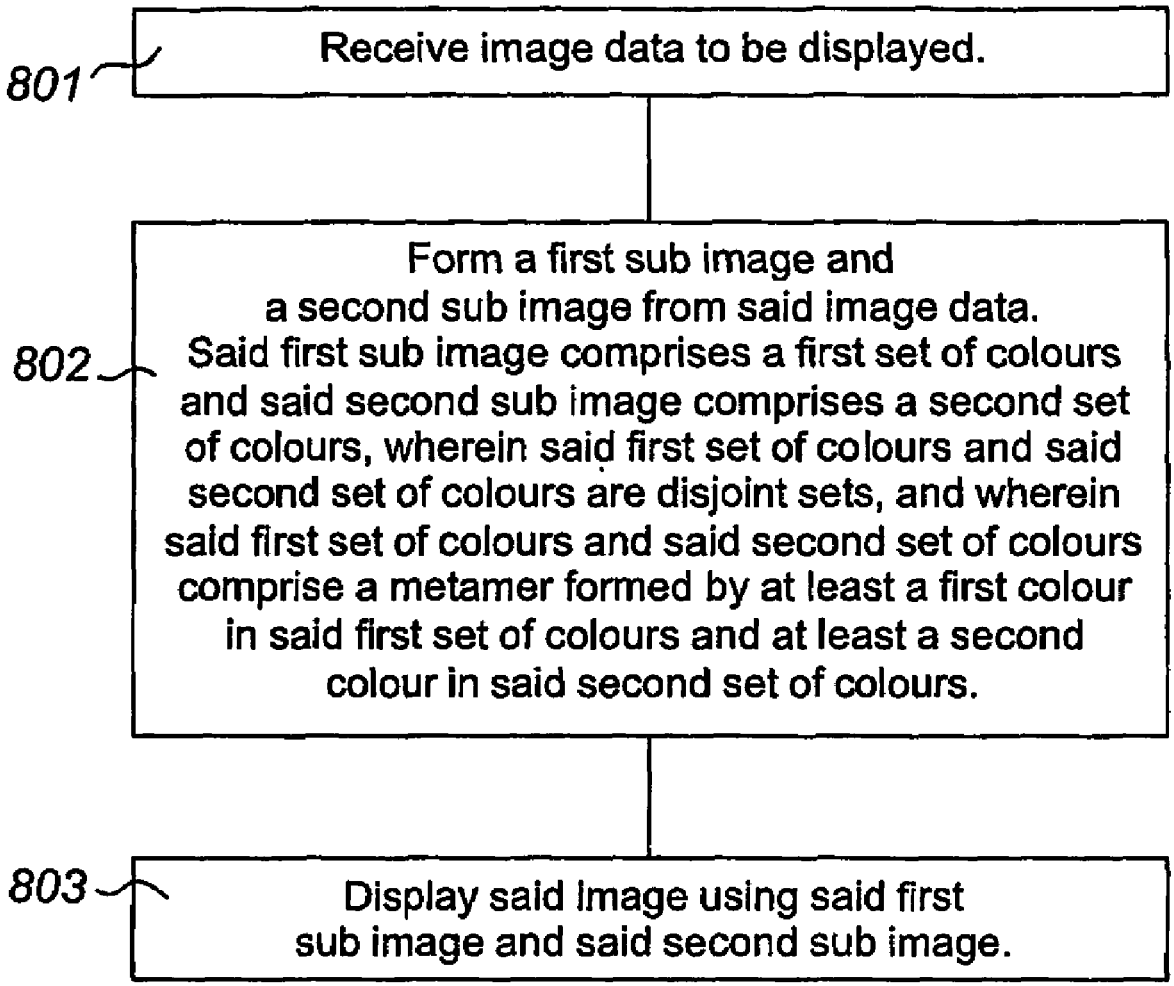

FIG. 8 is a schematic illustration of the method of displaying an image on a color display according to the invention.

The present invention relates to the field of color displays. Prior art multi color displays comprise displays with red, green and blue primary colors; and an additional primary color such as yellow or white.

When selecting an additional primary color, its impact on the luminance and the color gamut of a display should be taken into account. When considering the luminance alone, a primary color with a high luminance such as those in the triangle yellow-white-green appears desirable. Regarding the color gamut, with a view to extending the color gamut as much as possible, a highly saturated yellow, cyan or magenta would be preferred.

Yellow is furthermore a color which carries much brightness, and therefore a color, the absence of which is easily detected, and this is why adding more saturated yellow colors is generally most appreciated from a perception point of view. Considering all requirements, a yellow primary would be the best choice of an additional primary color in an RGB-display.

Figure 1:
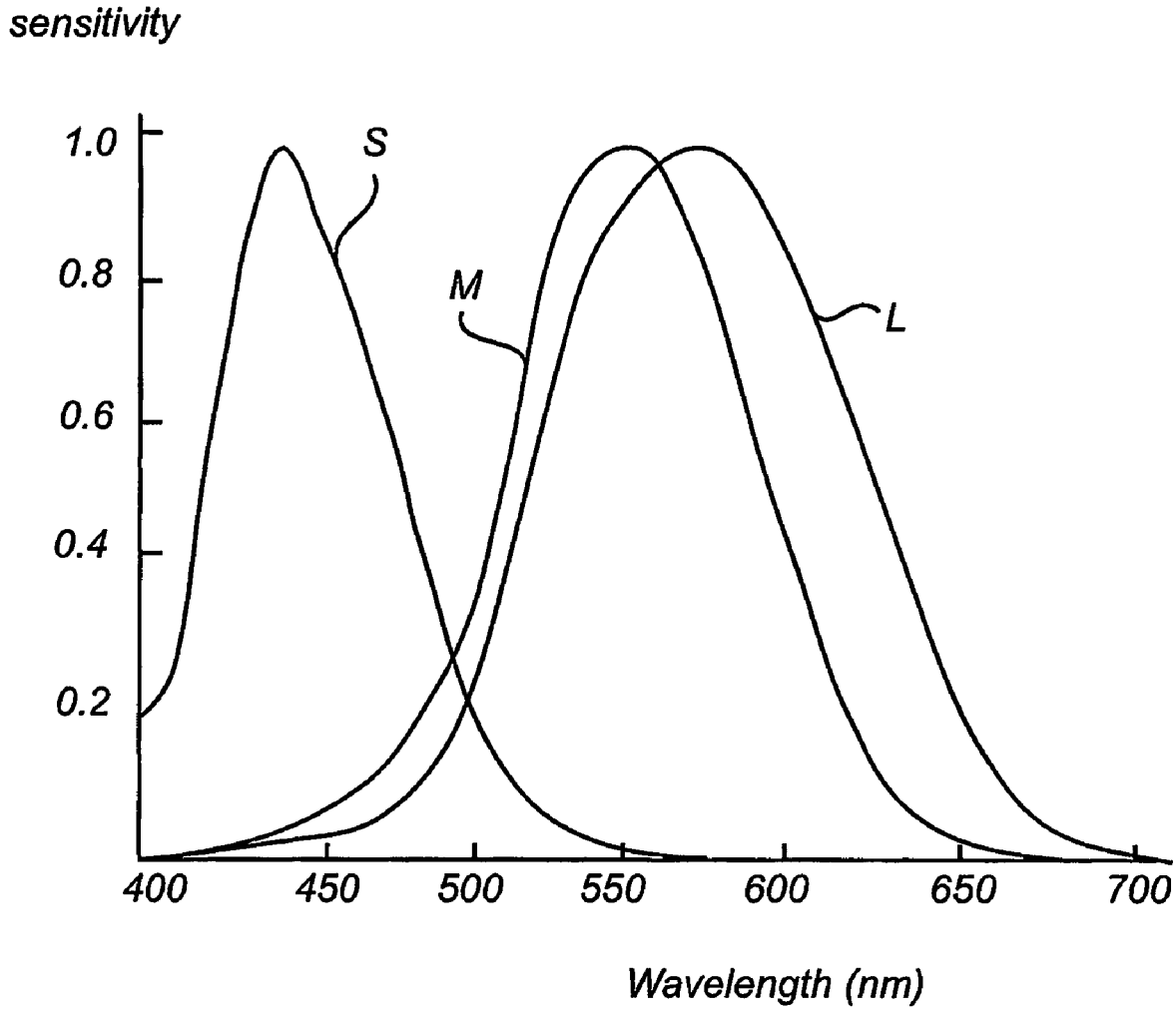
FIG. 1 shows the spectral sensitivities of L, M and S cones in the human eye.
Figure 2:
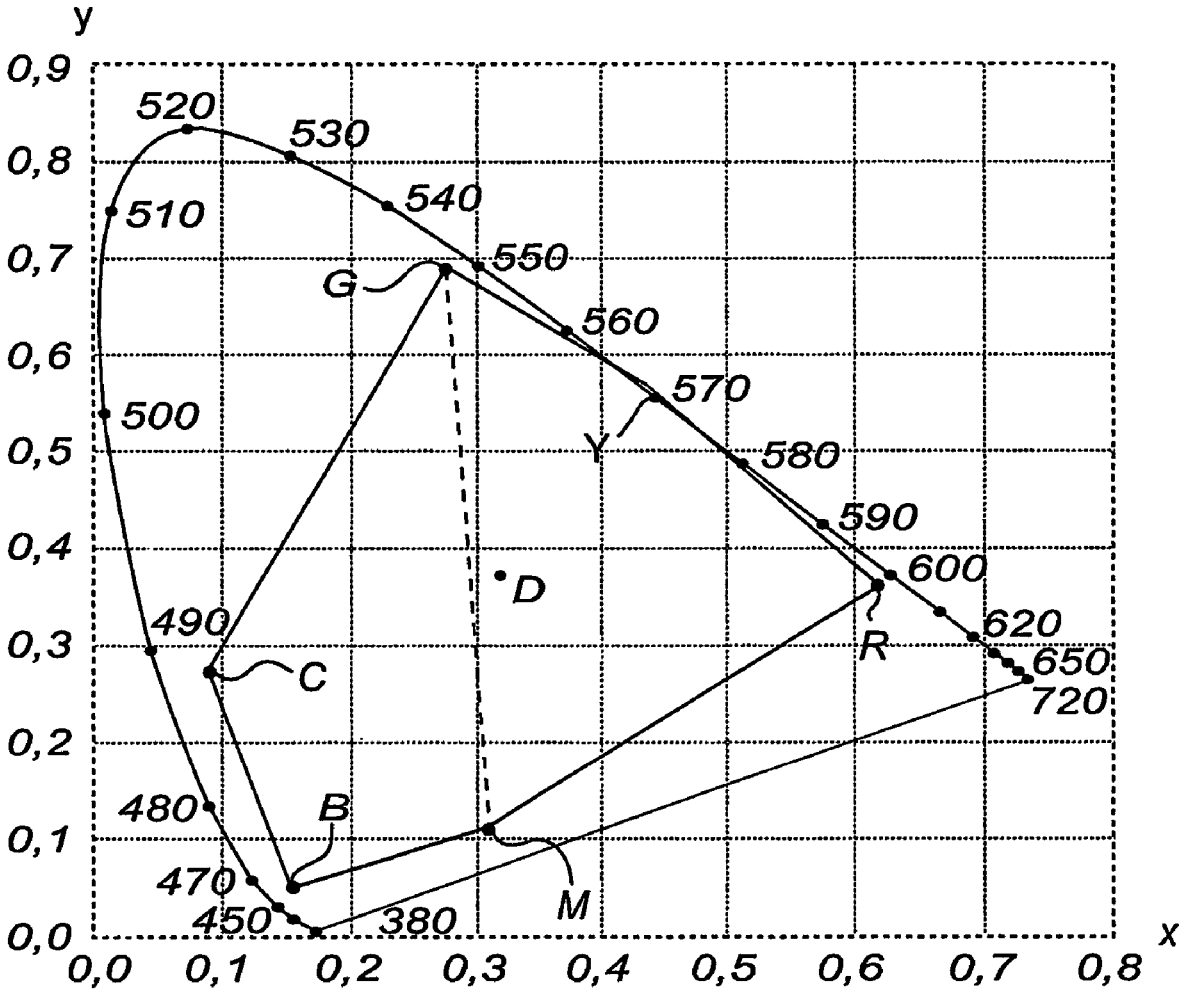
FIG. 2 is a chromaticity diagram.
Figure 3:
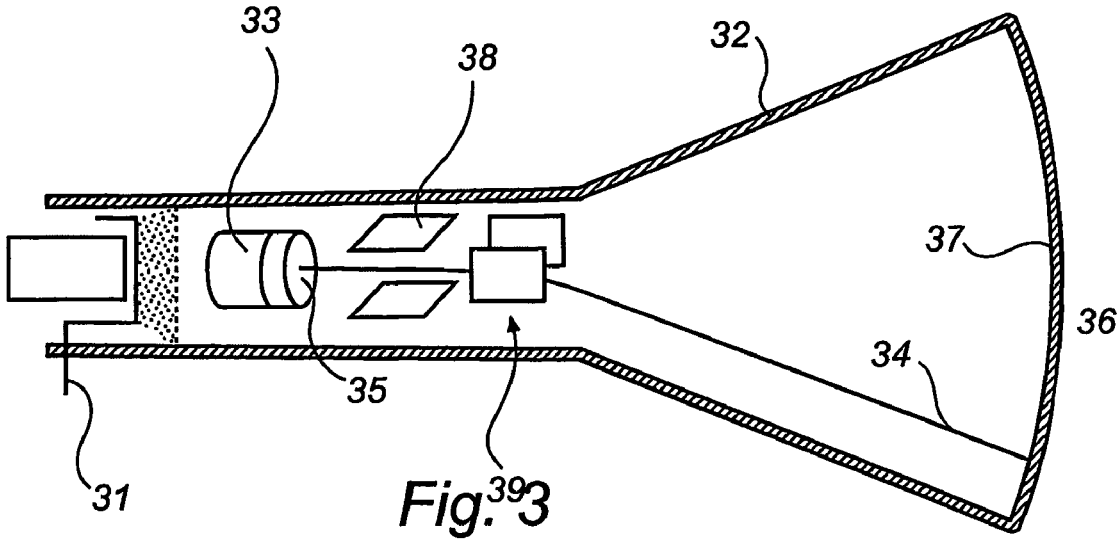
FIG. 3 is a schematic illustration of the fundamental principle of a cathode ray tube (CRT).
Figure 4:
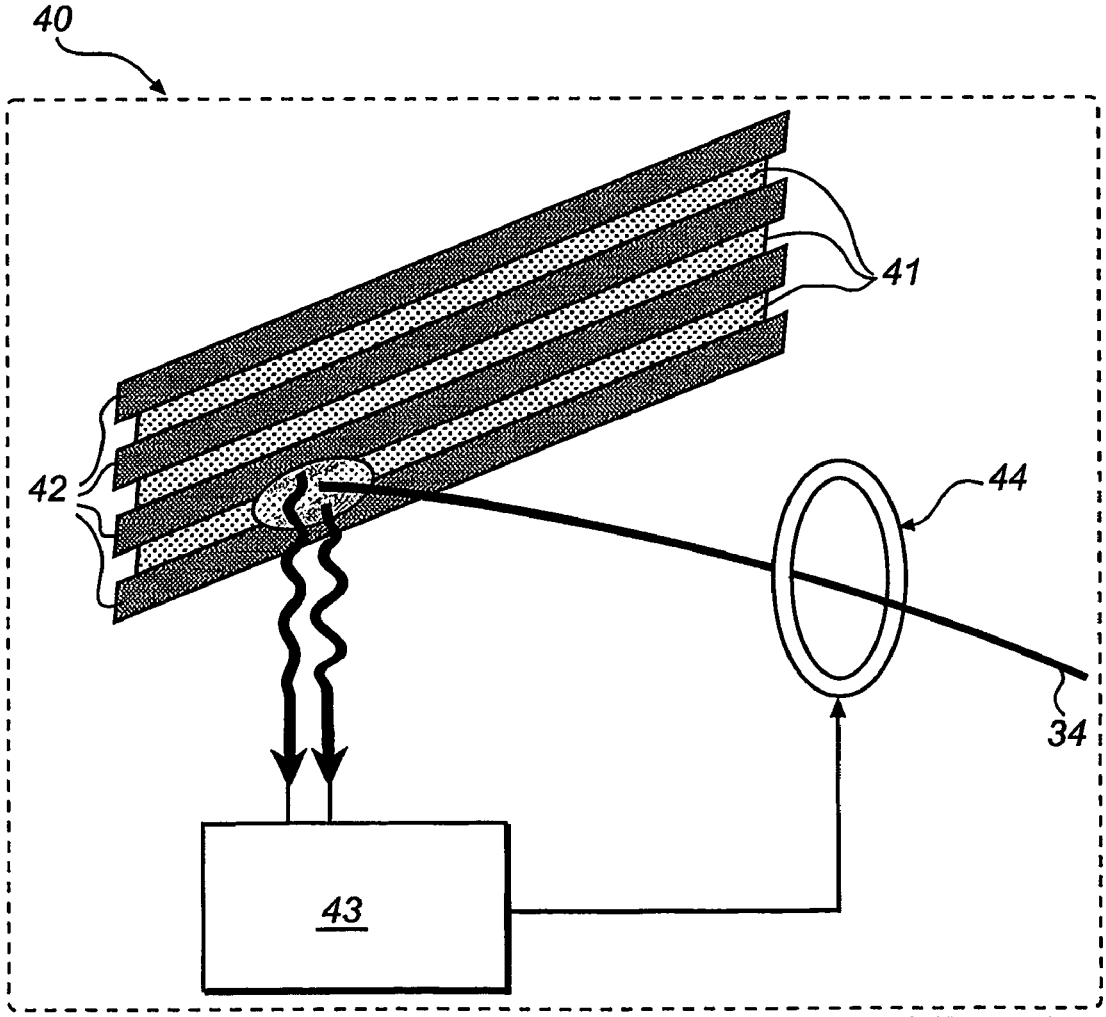
FIG. 4 is a simplified representation of the tracking principle in a Flat Intelligent Tube (FIT).

FIG. 1 illustrates the sensitivity of the cones in the human eye to light of various colors. The eye is very sensitive to yellow light (570 to 580 nm), which is why adding a yellow primary color to a prior art display with only red, green, and blue primary colors (RGB-display) would largely improve the overall brightness of an image displayed and the image quality.

Another color than yellow could nevertheless be a suitable fourth primary color if images of some special type were to be displayed. There may be several applications relating to the field of medical imaging or to the field of printing, wherein the first choice of an additional primary color would be another than yellow. Although the colors red, blue, green, cyan, magenta and yellow are mentioned as suitable colors in preferred embodiments of the invention, this should not be considered as a limitation to the invention.

In display technology, the luminance signal is defined as the signal that has the major control over the brightness. The color signal (chrominance signal) is defined as the signal that carries color information.

In human perception, the overall resolution of a display is mainly dominated by the resolution in the luminance signal and less in the color signal. Therefore, it would be preferable that the addition of a yellow primary would have no effect on the spatial resolution of the luminance signal. Since sub pixels for an additional primary color nevertheless must occupy some physical space on a display (unless the sub pixels are piled upon each other), the selection of a number of colors in prior art color display technology has constituted a trade-off wherein an increased color gamut has resulted in a poorer spatial resolution. Reducing the size of the sub pixels has until now constituted the only way of providing increased color gamut without a loss in resolution. A reduction in sub pixel size (typically width and/or length in the case of essentially rectangular sub pixels) is nevertheless associated with various problems such as decreased sub pixel performance, increased cost, decreased luminance, etc.

The inventors now propose a new method of displaying an image on a color display, in such a way that increased color gamut is obtained without the corresponding loss in resolution in the luminance signal which prior art is associated with.

The invention will mainly be explained with reference to an exemplary type of matrix, a four primary color LCD display comprising pixels arranged in rows and columns, wherein each pixel is built up from four sub pixels; e.g. a red sub pixel, a green sub pixel, a blue sub pixel and a yellow sub pixel constitute a pixel. The various sub pixels of each pixel can be controlled separately, i.e. the sub pixels of a pixel may be addressed independently of each other by a display controller.

The method according to the invention can be applied to multi color displays of various kinds, provided that the display at any given time comprises a spatially distributed plurality of display elements (such as sub pixels in the exemplary LCD display), said display elements being controllable to display a light having a certain predetermined color, and that the different display elements of the display are independently controllable.

The method comprises receiving image data to be displayed on a color display. Said image data may be provided as an amount of image material such as a TV signal, streaming video data or a similar signal comprising a sequence of image material.

A sequence of image material is typically built up of frames. As such, a frame may be defined as the image content which remains on each display element (such as the pixel in an LCD) during a predetermined time period. After a few milliseconds, typically 10-20 ms (assuming a typical frame refresh frequency of 50-100 Hz), the image content on each pixel is refreshed with new information.

Using said image data, a first sub image and a second sub image are formed. The first sub image comprises a first set of colors and the second sub image comprises a second set of colors, wherein said first set of colors and said second set of colors are disjoint sets, and wherein said first set of colors and said second set of colors comprise a metamer formed by at least a first color in said first set of colors and at least a second color in said second set of colors.

The forming of said first and second sub image may be performed by a display controller, associated with the particular display whereupon an image will be displayed, or in a nearby or remote image processing means or a similar device. The signal may itself comprise a first sub image and a second sub image.

The first sub image may for instance comprise red, green and blue colors (or a representation thereof), and the second sub image may for instance comprise blue and yellow colors (or a representation thereof), and the two sets are accordingly disjoint.

Although the invention will be described with reference to two separate sub images, this should not be considered to limit the invention, since the invention may be embodied using more than two sub images comprising various color sets as will be recognized by the skilled man.

The image is subsequently displayed using said first sub image and said second sub image, or a representation thereof, on a color display. This is preferably done using a display controller which may address the sub pixels of the exemplary display separately.

Preferably, the color sensation provided by said metamer is perceived as an essentially white color, so that black and white images may be produced by each of said first set of colors and said second set of colors.

Referring to the colors, a first set of colors preferably comprises red, green and blue, which are capable of producing a sensation of white light when combined. A second set of colors may preferably comprise blue and yellow, which also are capable of producing the sensation of white light when combined.

According to a first embodiment of the invention, said first sub image and said second sub image are displayed simultaneously during a time period. In that case, the method preferably comprises the additional step of forming a representation of said first sub image and said second sub image by averaging data associated with at least one and preferably all colors which are included in both said first set of colors and said second set of colors.

According to a second embodiment of the method, said first sub image and said second sub image are displayed sequentially in time during a time period. Said time period is preferably short enough to be perceived as a single frame by a human being, and said time period is more preferably being equal to or shorter than 20 milliseconds (corresponding to a refresh rate of 50 Hz)) and most preferably equal to or shorter than 10 milliseconds (corresponding to a refresh rate of 100 Hz).

Increased color gamut with improved resolution can be achieved by applying the method according to the second embodiment in a new addressing scheme, wherein each refresh frame is displayed twice using said first set of colors and said second set of colors.

According to an aspect of the invention, the sub pixels of said exemplary display may be associated with a first sub image and a second sub image, wherein blue (i.e. the blue sub pixels of the display) is included in both of said first set of colors and said second set of colors, but wherein the first set of colors in addition comprises red (i.e. the red sub pixels of the display) and green (i.e. the green sub pixels of the display), and wherein the second set of colors additionally comprises yellow (i.e. the yellow sub pixels of the display). Said first sub image and said second sub image are subsequently displayed time-sequentially, i.e. one after the other, within the frame time period. Preferably the displaying of said second subset is performed upon the end of the displaying of said first subset. The displaying of said first sub image may, however, partially or completely interlap the displaying of said second sub image.

According to the second embodiment of the invention, each blue sub pixel may accordingly be activated twice in every refresh frame—once in combination with the green sub pixels and the blue sub pixels, and once in combination with the yellow sub pixels. The invention will now be elucidated with reference to the following example.

Figure 5:
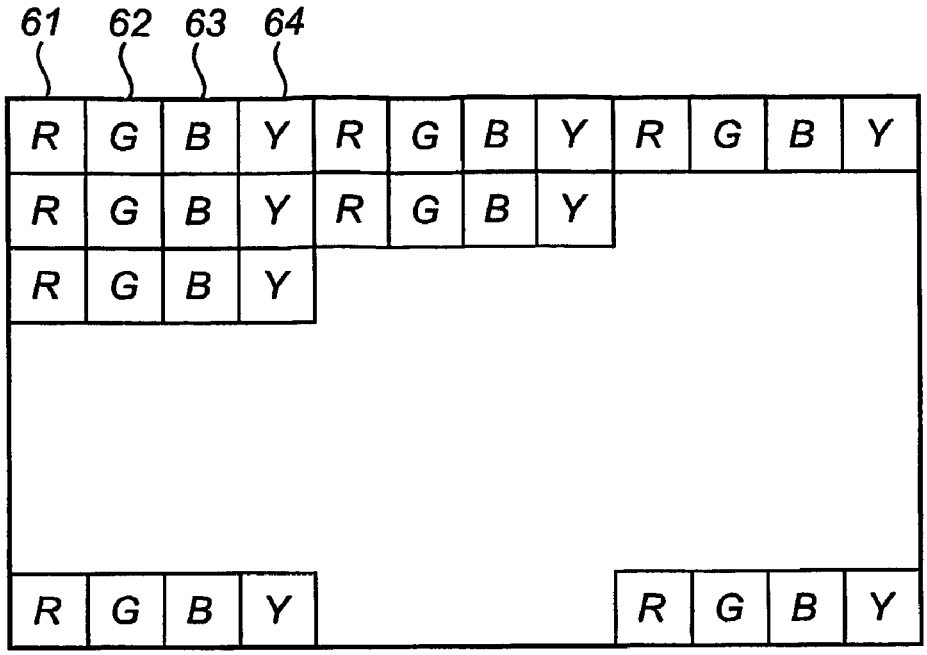
FIG. 5 is a schematic illustration of the screen of a multicolor liquid crystal display according to an embodiment of the invention.

FIG. 5 is a schematic illustration of the screen of a multicolor liquid crystal display according to an embodiment of the invention. The display screen comprises a matrix of pixels, which in turn are built up of a repeated arrangement of red, green, blue and yellow (RGBY) sub pixels (61, 62, 63 and 64, respectively). The arrangement of the pixels in the display should not be considered to constitute a limitation on the invention, since the pixels and the sub pixels may be of various regular or irregular shapes and arranged in a variety of regular or irregular patterns. The display is furthermore comprised of several components such as row and column conductors (not shown), connected to electronics (not shown), such as row and column drivers, all in a manner known by the skilled man and therefore not described here in order not to obscure the invention in unnecessary detail.

It should be noted that the fourth primary color can be added to a prior art RGB layout just as an additional stripe of yellow sub pixels which is positioned next to the blue and red colored stripes. There are many possible ways of arranging red, blue and green or yellow pixels in regular arrangements, for instance GRBY or GBRY or RGBY or BGRY. The latter two options are preferred because they are expected to result in the most homogeneous distribution of the luminance over the screen. In the case of the FIT display, the latter two options are expected to have the additional advantage of reducing the visibility of the horizontal line structure, which occurs as a consequence of the difference in brightness between green stripes on the one hand, and blue and red stripes on the other hand.

In the example described in the following, it is assumed that a video signal is fed to the display, said signal having a refresh rate of 50 Hz, i.e. a new image is to be displayed 50 times per second. A refresh frame (the image data) is then displayed during a frame time period of 20 ms.

Now assuming that an exemplary refresh frame image data, namely a white pixel on one of the display elements (pixels), is to be displayed by the display which has been previously described with reference to FIG. 5.

The red, green and blue sub pixels constitute a first subset of sub pixels, which may be activated during the first half of the time period associated with the refresh frame, namely 10 ms. Since a white pixel is to be displayed, the red, green and blue sub pixels are activated during the first 10 ms of the 20 ms refresh frame time period.

The red, blue and yellow sub pixels correspondingly constitute a second subset of sub pixels, which may be activated during the second half of said time period associated with said refresh frame. Since a white pixel is to be displayed, the red, blue and yellow sub pixels are activated during the remaining 10 ms of the 20 ms refresh frame time period.

Accordingly, a refresh frame of 20 ms is displayed as two subsequent refresh sub frames of 10 ms, using different subsets of the sub pixels.

Further advantages and aspects of the invention will become more apparent from the subsequent example, wherein a pattern of black and white stripes is to be displayed.

Figure 6:
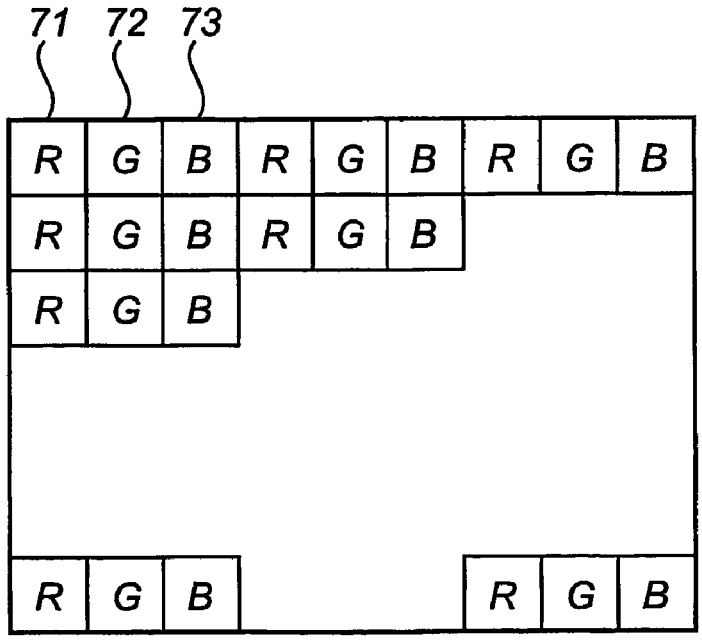
FIG. 6 is a schematic illustration of the screen of a prior art three color RGB-display.

FIG. 6 is a schematic illustration of the screen of a prior art three color RGB-display. The display screen comprises a matrix of pixels, which in turn are built up of a repeated arrangement of red, green and blue sub pixels (71, 72 and 73, respectively).

In order to display a pattern of black and white stripes using conventional technology, vertical stripes of pixels are alternatingly activated and not activated. That is the sub pixels forming each activated pixel are activated whereas the sub pixels forming each non-activated pixel are not activated.

FIG. 7*a* is a schematic illustration of the perceived image on the screen of a three color RGB-display according to FIG. 6. The distance labelled p denotes the display pitch, which is inversely proportional to the resolution, as 6 sub pixel elements.

FIG. 7*b* is a schematic illustration of the perceived image on the screen of a four-color display using conventional addressing techniques analogously with the display described with reference to FIGS. 6 and 7*a*. In addition to the red, green and blue sub pixels of the prior art three color RGB-display, every pixel in the four color display according to the invention comprises yellow sub pixels.

The distance labelled p denotes the display pitch as 8 sub pixel elements. Although increased color gamut is obtained as compared to the display of FIG. 6, the additional pixel implies a loss in the spatial resolution when conventional addressing is used, which is illustrated by the increasing pixel size and hence increasing distance between two pixels. The spatial resolution in the color signal of a prior art four color display is hence typically reduced by a factor 0.75 with respect to a three-color display.

Every pixel in the four-color display according to the invention comprises yellow sub pixels, analogously with the display described previously with reference to FIG. 7*b*.

Now assuming the black-and-white-striped pattern is to be displayed on a display according to the invention, a single pixel could be used to display both a part of the black stripe and a part of the white stripe. This is achieved by time-sequentially displaying a first and a second subset of pixels, wherein the sub pixels of a first subset of the pixels, namely the red, green and blue sub pixels on the left-hand side of each pixel in the present embodiment, are activated to display white, and wherein the sub pixels of the second sub frame, namely the sub pixels on the right hand side of the pixel, are subsequently not activated in order to display black, the subsets being activated alternatingly.

Such a time-sequential activation of two subsets of sub pixels in every refresh frame allows for addition of a fourth primary color without loss in the luminance signal in a display type in which the various colors are designed in stripes.

The gain in horizontal resolution in the luminance signal is also illustrated. For displaying a grey bar, one in principle needs four pixels to display four different grey levels. In case a fourth primary is added, and one has the possibility to address the red and blue pixels twice in one frame, six different grey levels can be located in the same horizontal space, which illustrates how the increase in spatial resolution in the luminance signal is realized.

FIG. 7*c* is a schematic illustration of the perceived image on the screen of a four color display according to the invention.

It should be noted, that this particular arrangement should not be interpreted as a limitation of the invention, since the four colors could be arranged in various other symmetrical or irregular arrangements. The distance p denotes the spatial resolution in this case as 4d, wherein d represents the size (width, length or corresponding dimension determining the area of the sub pixel in a non-rectangular sub pixel) of a sub pixel.

The invention also relates to a display controller characterized in that said display controller is arranged to perform the method according to the invention and to a display comprising such a display controller.

Preferably, the display is a liquid crystal (LCD) display, a cathode ray tube (CRT) display with non-overlapping electron beams, a flat intelligent tube (FIT) display, a plasma display panel (PDP), a polylight emitting diode (PolyLED) display, an organic light emitting diode (OLED) display or a field emission display (FED).

FIG. 8 is a schematic illustration of the method of displaying an image on a color display according to the invention. In step 801, image data to be displayed on a display is received. In step 802, a first sub image and a second sub image are formed from said image data, said first sub image comprising a first set of colors and said second sub image comprising a second set of colors, wherein said first set of colors and said second set of colors are disjoint sets, and wherein said first set of colors and said second set of colors comprise a metamer formed by at least a first color in said first set of colors and at least a second color in said second set of colors. In step 803, said image is displayed using said first sub image and said second sub image, or a representation thereof, on a color display.

The invention may accordingly be applied in every display that can only display a limited number of colors, defined by a color triangle (i.e. virtually every display except laser displays), exhibits a loss in spatial resolution by adding additional primaries (i.e. every display except color-sequential projection systems), and is able to address each color separately i.e. not CRT displays, unless the color beams are non-overlapping as in a FIT display). From these constraints it is evident that the invention is most easily implemented in FIT displays and LCDs. Moreover, in view of the limited color gamut that can be displayed with reflective LCDs, the invention is expected to have the greatest impact on those displays.

In order to limit the impact on the production process as a consequence of adding other primaries to a display, and in order to limit the loss in spatial resolution, only the yellow primary color was added in the embodiment disclosed above.

The skilled man will however realize, that the color might be another color or that more than one extra color might be added.

Hence a new and innovative display which presents the best homogeneity in color and luminance and limits the color and luminance errors and maximizes the resolution for images comprising black and white text has been proposed.

The illustrated arrangements of the pixels in the displays should not be considered to constitute a limitation, since pixels and sub pixels may be of various regular or irregular shapes and arranged in a variety of regular or irregular patterns.

The method according to the invention may be performed by the existing control circuitry of a display and/or other components associated with a display.

The display controller according to the invention can be realized by the existing display controller of a display or as a separate, stand-alone unit. The display controller can be realized as hardware, such as integrated circuits (ASIC) Field Programmable Gate Arrays (FPGA), discrete analogue and/or digital components, or as software to be executed by a processor, or as any combination thereof.

The display according to the present invention may, for example, be realized as a separate, stand-alone unit, or may alternatively be included in, or combined with, a mobile terminal for a telecommunications network, such as GSM, UMTS, GPS, GPRS or D-AMPS, or another portable device of existing type, such as a Personal Digital Assistant (PDA), palmtop computer, portable computer, electronic calendar, electronic book, television set or video game control, as well as other office automation equipment and audio/video machinery, etc.

The invention has mainly been described above with reference to main embodiments. However, other embodiments than the ones disclosed above are equally possible within the scope of the invention, as defined by the appended patent claims. All terms used in the claims are to be interpreted according to their ordinary meaning in the technical field, unless explicitly defined otherwise herein. All references to "a/an/the [element, means, component, member, unit, step etc.]" are to be interpreted openly as referring to at least one instance of said element, means, component, member, unit, step etc. The steps of the methods described herein do not have to be performed in the exact order disclosed, unless explicitly specified.

The invention claimed is:

1. A method of displaying a current image on a color display, the method comprising the acts of:

receiving current image data representing the current image to be displayed during a frame for a refresh frame period by activating pixels of the color display, the activated pixels remaining on during the refresh frame period and changing during a next refresh frame period to display a next image data which is different from the current image data;

forming from said current image data a first sub-image by activating a first set of sub-pixels during a first portion of the refresh frame period of said image and a second sub-image by activating a second set of sub-pixels during a second portion of the refresh frame period, said first set of sub-pixels comprising a first set of colors and said second set of sub-pixels comprising a second set of colors, wherein said first set of colors and said second set of colors are different sets of colors and include increased number of colors, and wherein said first set of colors and said second set of colors comprise a metamer formed by at least a first color in said first set of colors and at least a second color in said second set of colors so that substantially the current image data is displayed during both the first portion and the second portion of the refresh frame period; and displaying said image using said first sub image and said second sub image, or a representation thereof, on the color display with increased resolution without reducing a size of the sub-pixels, and using the increased number of colors to provide the increased resolution without a corresponding loss in resolution and without an increase in a size of a pixel by displaying the current image twice during the refresh frame period using the first set of sub-pixels and the second set of sub-pixels.

2. The method according to claim 1, wherein the color sensation provided by the metamer is perceived as an essentially white color.

3. The method according to claim 1, wherein said first sub image and said second sub image are displayed simultaneously during a time period.

4. The method according to claim 3, additionally comprising:

forming a representation of said first sub image and said second sub image by averaging data associated with any colors which are included in both said first set of colors and said second set of colors.

5. The method according to claim 1, wherein said first sub image and said second sub image are displayed sequentially in time during a time period.

6. The method according to claim 3, wherein the time period is short enough to be perceived as a single frame.

7. The method according to claim 5, said time period being equal to or shorter than 20 milliseconds.

8. A method according to claim 5, said time period being equal to or shorter than 10 milliseconds.

9. The method according to claim 1, wherein the first set of colors comprises red, green and blue.

10. The method according to claim 1, wherein the second set of colors comprises blue and yellow.

11. The method of claim 1, wherein said first set of colors comprising said metamer and said second set of colors comprising said metamer include a common color, and wherein the displaying act displays the common color twice during the refresh frame period of said image.

12. The method of claim 11, wherein the common color is blue.

13. The method of claim 1, wherein the refresh frame period is 20 Oms and the first portion of the refresh frame period is a first half of the refresh frame period and is 10 ms, and the second portion of the refresh frame period is a second half of the refresh frame period and is 10 ms.

14. The method of claim 1, wherein the first portion of the refresh frame period is a first half of the refresh frame period, and the second portion of the refresh frame period is a second half of the refresh frame period.

15. A display controller for controlling a color display to display a current image, the display controller being configured to:

receive current image data representing the current image to be displayed as the current image during a frame for a refresh frame period by activating pixels of the color display;

form from said current image data a first sub-image by activating a first set of sub-pixels during a first portion of a refresh frame period of said image and a second sub-image by activating a second set of sub-pixels during a second portion of the refresh frame period, said first set of sub-pixels comprising a first set of colors and said second sub image comprising a second set of colors, wherein said first set of colors and said second set of colors are different sets of colors and include increased number of colors, and wherein said first set of colors and said second set of colors comprise a metamer formed by at least a first color in said first set of colors and at least a second color in said second set of colors so that substantially the current image data is displayed during both the first portion and the second portion of the refresh frame period; and display said image using said first sub image and said second sub image, or a representation thereof, on the color display with increased resolution without reducing a size of the sub-pixels, and using the increased number of colors to provide the increased resolution without a corresponding loss in resolution and without an increase in a size of a pixel by displaying the current image twice during the refresh frame period using the first set of sub-pixels and the second set of sub-pixels.

16. The display controller of claim 15, wherein said first set of colors comprising said metamer and said second set of colors comprising said metamer include a common color, and wherein the display controller is further configured to display the common color twice during the refresh frame of said image.

17. The display controller of claim 16, wherein the common color is blue.

18. The display controller of claim 15, wherein the first portion of the refresh frame period is a first half of the refresh frame period, and the second portion of the refresh frame period is a second half of the refresh frame period.

19. A display comprising a display controller for controlling the display to a current image, the display controller being configured to:

receive current image data representing the current image to be displayed as the current image during a frame for a refresh frame period by activating pixels of a color display;

form from said current image data a first sub-image by activating a first set of sub-pixels during a first portion of a refresh frame period of said image and a second sub-image by activating a second set of sub-pixels during a second portion of the refresh frame period, said first set of sub-pixels comprising a first set of colors and said second set of sub-pixels comprising a second set of colors, wherein said first set of colors and said second set of colors are different sets of colors and include increased number of colors, and wherein said first set of colors and said second set of colors comprise a metamer formed by at least a first color in said first set of colors and at least a second color in said second set of colors so that substantially the current image data is displayed during both the first portion and the second portion of the refresh frame period; and display said image using said first sub image and said second sub image, or a representation thereof, on the color display with increased resolution without reducing a size of the sub-pixels, and using the increased number of colors to provide the increased resolution without a corresponding loss in resolution and without an increase in a size of a pixel by displaying the current image twice during the refresh frame period using the first set of sub-pixels and the second set of sub-pixels.

20. The display according to claim 19, wherein said display is one of a liquid crystal (LCD) display, a cathode ray tube (CRT) display with non overlapping electron beams, a flat intelligent tube (FIT) display, a plasma display panel (PDP), a polylight emitting diode (PolyLED) display, an organic light emitting diode (OLED) display and a field emission display (FED).

21. The display of claim 19, wherein said first set of colors comprising said metamer and said second set of colors comprising said metamer include a common color, and wherein the display controller is further configured to display the common color twice during the refresh frame of said image.

22. The display of claim 21, wherein the common color is blue.

23. The display of claim 19, wherein the first portion of the refresh frame period is a first half of the refresh frame period, and the second portion of the refresh frame period is a second half of the refresh frame period.

* * * * *